US008961372B2

(12) United States Patent
Hasta

(10) Patent No.: US 8,961,372 B2
(45) Date of Patent: Feb. 24, 2015

(54) POSTURE-ASSISTED YOGA MATS AND TOWELS

(76) Inventor: Ali Hasta, Dubai (AE)

( * ) Notice: Subject to any disclaimer, the term of this patent is extended or adjusted under 35 U.S.C. 154(b) by 0 days.

(21) Appl. No.: 13/543,735

(22) Filed: Jul. 6, 2012

(65) Prior Publication Data

US 2014/0007345 A1 Jan. 9, 2014

(51) Int. Cl.
*A63B 5/16* (2006.01)

(52) U.S. Cl.
USPC ..... 482/23; 5/420

(58) Field of Classification Search
USPC ..... 5/417, 420; 482/23, 142, 148, 909; D6/582
See application file for complete search history.

(56) References Cited

U.S. PATENT DOCUMENTS

| | | | | |
|---|---|---|---|---|
| 6,387,013 | B1 * | 5/2002 | Marquez | 482/23 |
| 7,108,635 | B2 * | 9/2006 | Howlett-Campanella | 482/23 |
| D584,093 | S * | 1/2009 | Drumm | D6/582 |
| 2001/0034288 | A1 * | 10/2001 | Howlett-Campanella | 482/23 |
| 2002/0142888 | A1 * | 10/2002 | Marques | 482/23 |
| 2004/0214692 | A1 * | 10/2004 | Koenig | 482/23 |
| 2009/0239724 | A1 * | 9/2009 | White | 482/142 |
| 2010/0240508 | A1 * | 9/2010 | Guarrasi | 482/142 |
| 2011/0131723 | A1 * | 6/2011 | Andrews | 5/417 |
| 2012/0233772 | A1 * | 9/2012 | Wang | 5/417 |
| 2013/0180048 | A1 * | 7/2013 | Saltzman | 5/417 |

* cited by examiner

*Primary Examiner* — Peter M Cuomo
*Assistant Examiner* — Brittany Wilson
(74) *Attorney, Agent, or Firm* — The Law Office of Charlena Thorpe, Inc.; Charlena Thorpe, Esq.

(57) ABSTRACT

Various implementations of this disclosure provide apparatuses and methods for assisting users to align and place limbs to perform various yoga positions. Apparatuses and method disclosed herein comprise a towel or mat having markings (e.g., lines, dots, circles, or any other indication) to help a user align and place the user's limbs. Some of the markings can be used to measure distances as some of the markings are a predetermine distance apart.

19 Claims, 13 Drawing Sheets

POSTURE-ASSISTED YOGA MATS AND TOWELS

TECHNICAL FIELD

This disclosure relates to yoga mats and towels.

BACKGROUND

Yoga is typically associated with a collection of postures or positions. These postures can vary from very simple postures to complex postures. Yoga postures include, but are not limited to, for example, standing poses, seated poses, twisted poses, supine poses, inverted poses, balance poses, and Bikram Yoga poses. With each posture, a user's body parts (e.g., arms, hands, legs, feet, and/or torso) must be correctly aligned or placed to achieve the correct pose and the benefit of that pose.

DETAILED DESCRIPTION

Various implementations of this disclosure provide apparatuses and methods for assisting users to align and place limbs to perform various yoga positions. Apparatuses and method disclosed herein comprise a towel or mat having markings (e.g., lines, dots, circles, or any other indication) to help a user align and place the user's limbs. Some of the markings can be used to measure distances as some of the markings are a predetermine distance apart.

Although this disclosure makes reference to yoga positions, the disclosure is not limited to yoga position. This disclosure is applicable to any body posture for any purpose.

Figure 1:
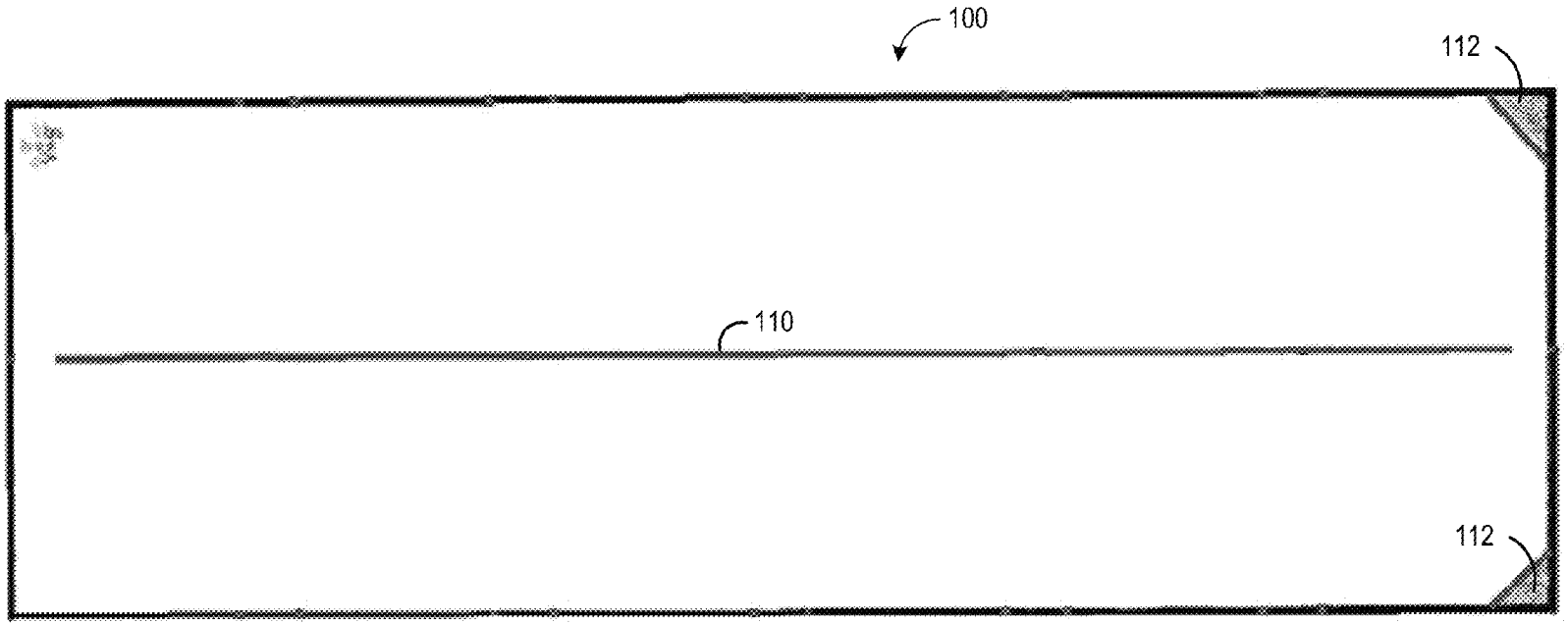
FIGS. 1-9 illustrate example embodiments of a towel or mat that can be used to help a user align and/or place the user's limbs or any body part to perform one or more yoga positions.

FIG. 1 illustrates a first embodiment of a towel or mat 100 that can be used to help a user align and/or place the user's limbs or any body part to perform one or more yoga positions. The towel or mat 100 include a length-wise center line 110 that extends length-wise along the center of the towel or mat 100. In some implementations, the towel or mat 100 is at least six feet long and two feet wide. As an example, the length-wise center line 110 can be used to aide a user to align and place the user's hands, arms, torso, legs, and feet to perform the Balancing Stick Pose in Bikram Yoga.

The towel or mat 100 also can include shaded areas 112 in the corners. In some implementations, the shaded areas 112 serve as indicators of the part of the towel 100 that can be used to wrap around a user's when a user is performing a yoga posture such as the Rabbit Pose in Bikram Yoga, for example.

Figure 2:
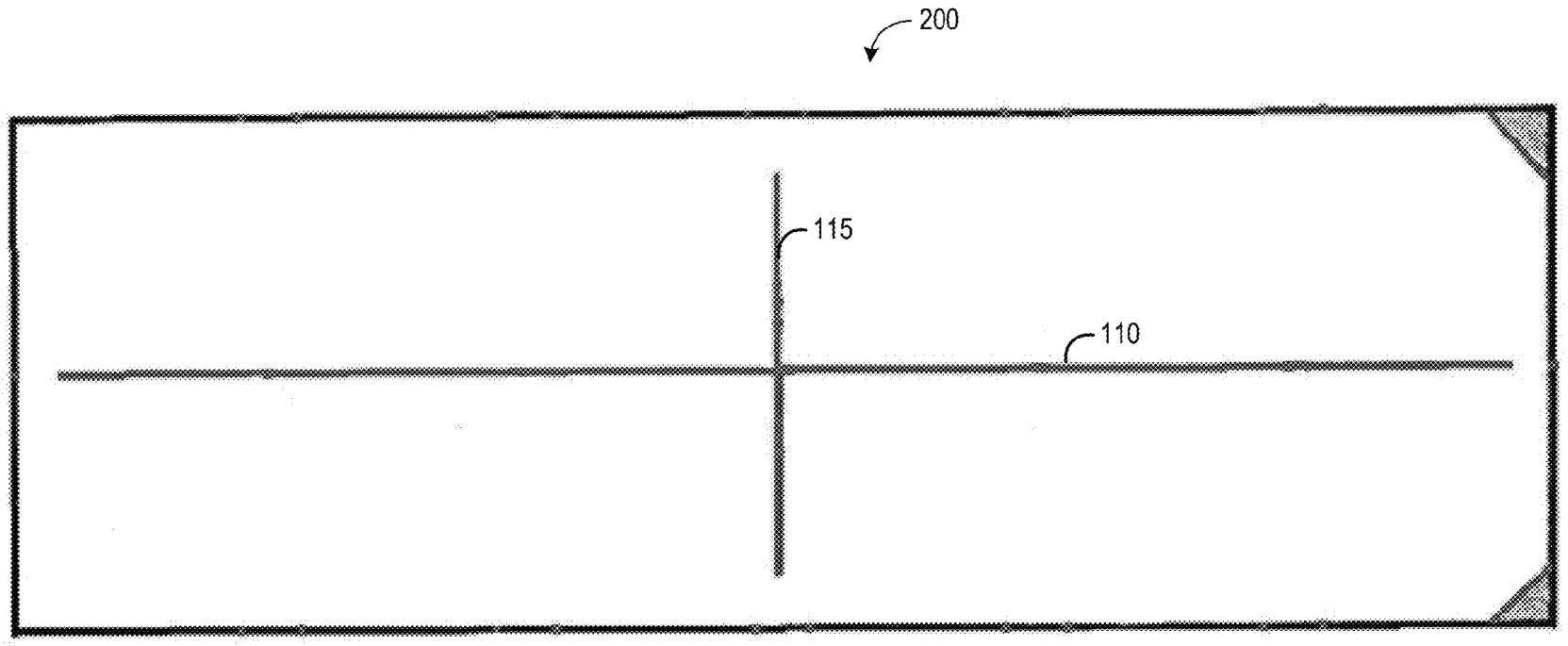

FIG. 2 illustrates a second embodiment of a towel or mat 200 that can be used to help a user align and/or place the user's limbs or any body part to perform one or more yoga positions. The towel or mat 200 include a length-wise center line 110 that extends length-wise along the center of the towel or mat 100 and a width-wise center line 115 that extends width-wise along the center of the towel or mat 100. In some implementations, the width-wise center line 115 intersects the length-wise center line 110 at a right angle. The width-wise center line 115 can help a user realize the center of the mat. Furthermore, the length-wise center line 110 and the width-wise center line 115 can be used to help a user align and position body parts at right angles for those postures that requires such positions. For example, the length-wise center line 110 and the width-wise center line 115 can be used to aide a user to perform the Standing Separate Leg Stretching Pose in Bikram Yoga. As another example, For example, the length-wise center line 110 and the width-wise center line 115 can be used to aide a user to determine the center of the mat or towel to perform breathing postures and the Half Moon Pose in Bikram Yoga.

Figure 3:
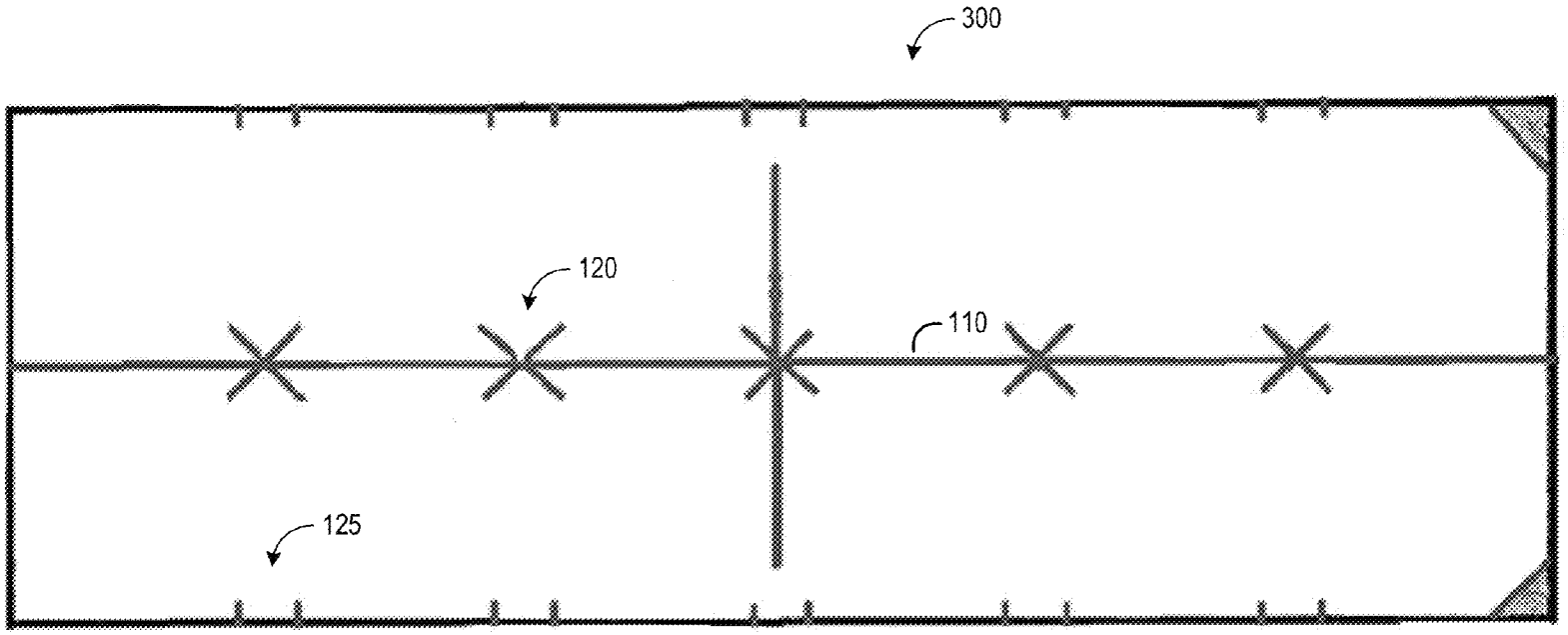

FIG. 3 illustrates a third embodiment of a towel or mat 300 that can be used to help a user align and/or place the user's limbs or any body part to perform one or more yoga positions. The towel or mat 300 includes all the marks of FIG. 2 and adds crosses 120 along the length-wise center line 110 and sets of double lines 125 around the perimeter of the towel or mat 300. In some implementations, the distance between the crosses is one foot. In some implementations, the distance between the crosses is any other distance. In some implementations, the lines of the crosses 120 and the length-wise center line 110 measure forty-five degrees. Thus, the length-wise center line 110 and a line of a cross 120 can be used to help a user align and position body parts at forty-five degree angles for those postures that requires such positions. For example, the length-wise center line 110 and a line of a cross 120 can be used to aide a user to perform the Standing Separate Leg Head to Knee Pose in Bikram Yoga. As there are several lines at forty-five degrees from the length-wise center line 110, a user can stand in several directions to achieve any posture that requires body parts to be at forty-five degree angles.

In some implementations, the distance between the lines of each set of double lines 125 is 5 inches. In some implementations, the distance between the lines of each set of double lines 125 is any other distance. Thus, a set of double lines 125 can be used to measure a distance. Furthermore, a set of double lines 125 can be used to help a user align and position body parts a certain distance apart for those postures that requires such positions. For example, a set of double lines 125 can be used to aide a user to perform the Spine-Twisting Pose in Bikram Yoga. In the Spine-Twisting Pose, a set of the double lines 125 can be used to help place the knee of one leg (aligned with one line of the double line 125) and the ankle of the other leg (aligned with the other line of the double line 125) a certain distance apart as measured by the distance between the lines of the double lines 125. As there are numerous sets of double lines 125 around the perimeter of the towel or mat 300, a user has numerous locations on the towel or mat 300 to perform a posture requiring the use of a set of double lines 125.

Figure 4:
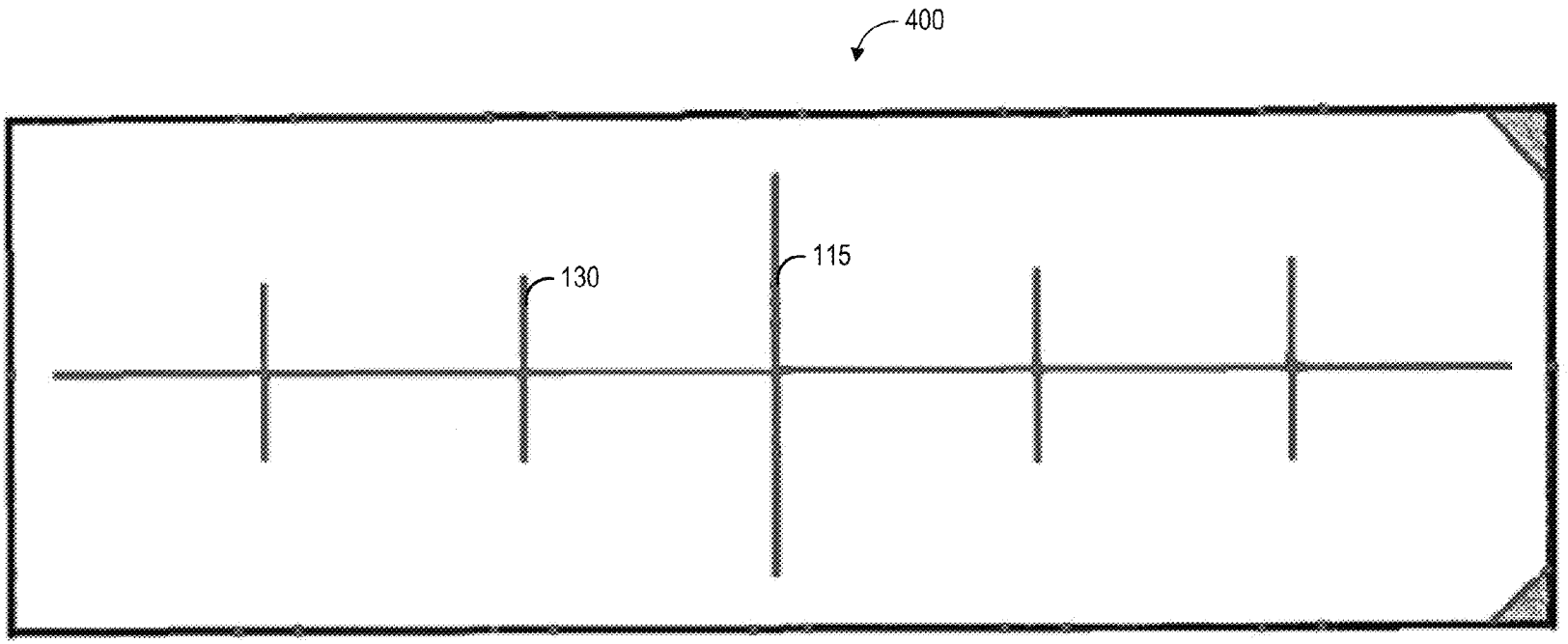

FIG. 4 illustrates a fourth embodiment of a towel or mat 400 that can be used to help a user align and/or place the user's limbs or any body part to perform one or more yoga positions. The towel or mat 400 includes all the marks of FIG. 2 and adds additional width-wise lines 130 intersecting the length-wise center line 110 at a right angle. In some implementations, the width-wise lines 130 and the width-wise center line 115 are spaced apart by 1 foot. In some implementations, the width-wise lines 130 and the width-wise center line 115 are all any other predetermined distance apart. Thus, the width-wise lines 130 and the width-wise center line 115 can be used to measure a distance. Furthermore, any one of width-wise lines 130 can be used for the same purpose as width-wise center line 115 as described in FIG. 2.

Furthermore, the width-wise lines 130 and the width-wise center line 115 can be used to help a user align and position body parts a certain distance apart for those postures that requires such positions. For example, some postures require the user to keep the user's feet 3 feet apart or 4 feet apart.

Thus, the user could use the width-wise lines 130 and the width-wise center line 115 to measure distance to help ensure that the user's feet are the requisite distance apart. For example, the width-wise lines 130 and the width-wise center line 115 can be used to aide a user to perform the Triangle Pose in Bikram Yoga. For the Triangle Pose, the width-wise lines 130 and the width-wise center line 115 can be use to measure the distance between the feet. Also, the width-wise lines where the feet are ultimately positioned can be used to assure that the feet are aligned and/or positioned properly.

In some implementations, the length of the width-wise lines 130 is 10 inches. In some implementations, the length of the width-wise lines 130 is any other length. Thus, a width-wise line 130 can be used to measure a distance. Furthermore, a width-wise line 130 can be used to help a user align and position body parts a certain distance apart for those postures that requires such positions. For example, some postures require the user to keep the user's feet 10 inches apart. Thus, the user could use a width-wise line 130 to measure distance to help ensure that the user's feet are the requisite distance apart. For example, a width-wise line 130 can be used to aide a user to perform the Awkward Pose in Bikram Yoga.

Figure 5:
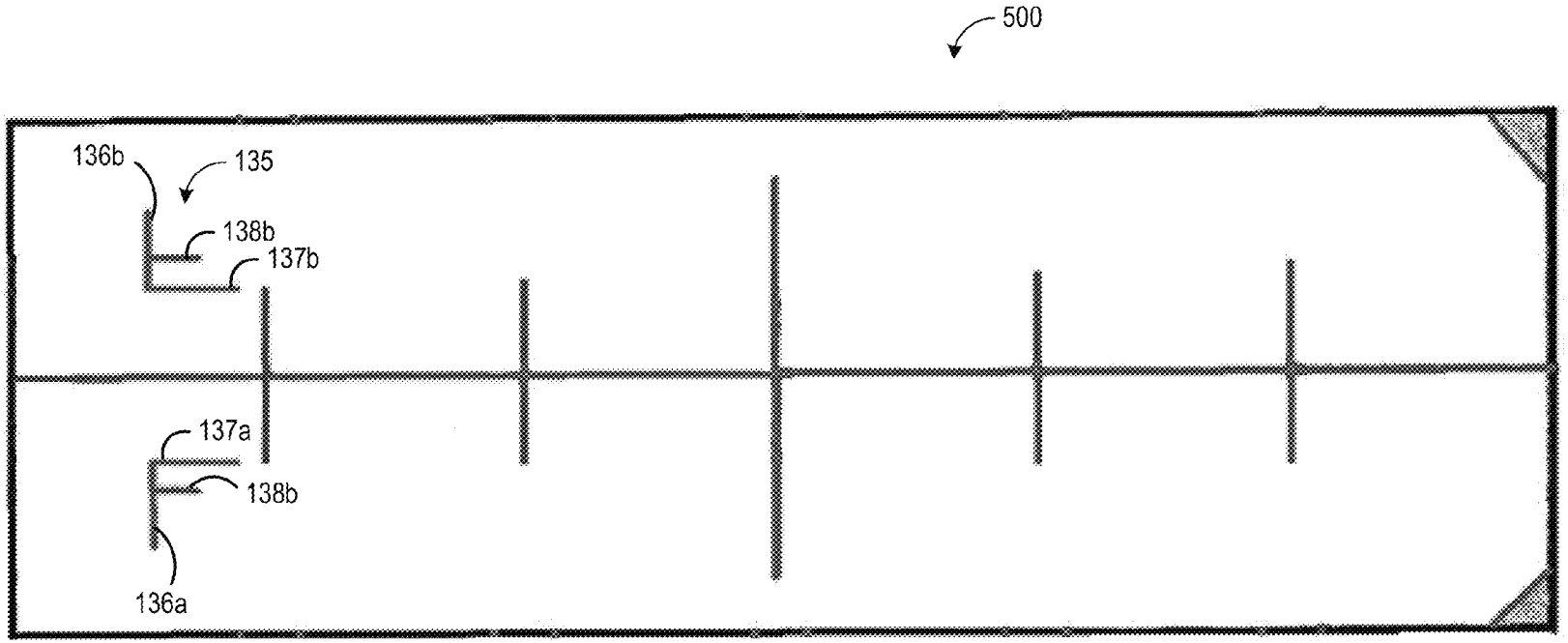

FIG. 5 illustrates a fifth embodiment of a towel or mat 500 that can be used to help a user align and/or place the user's limbs or any body part to perform one or more yoga positions. The towel or mat 500 includes all the marks of FIG. 4 and adds "F-designs" 135. The F-designs 135 can be used to aide a user to perform the Cobra Pose in Bikram Yoga. The horizontal lines 136*a, b* and one of the pairs of vertical lines that are parallel to the length-wise center line 110 (137*a,* 137*b*) or (138*a,* 138*b*), depending on the size of the user, can be used to align and/ or place the user's left and right hands, respectively. As another example, the F-designs 135 can be used to aide a user to perform the Fixed Firm Pose in Bikram Yoga. The horizontal lines 136*a, b* can be used to align and/or place the user's left and right knees, respectively.

Figure 6:
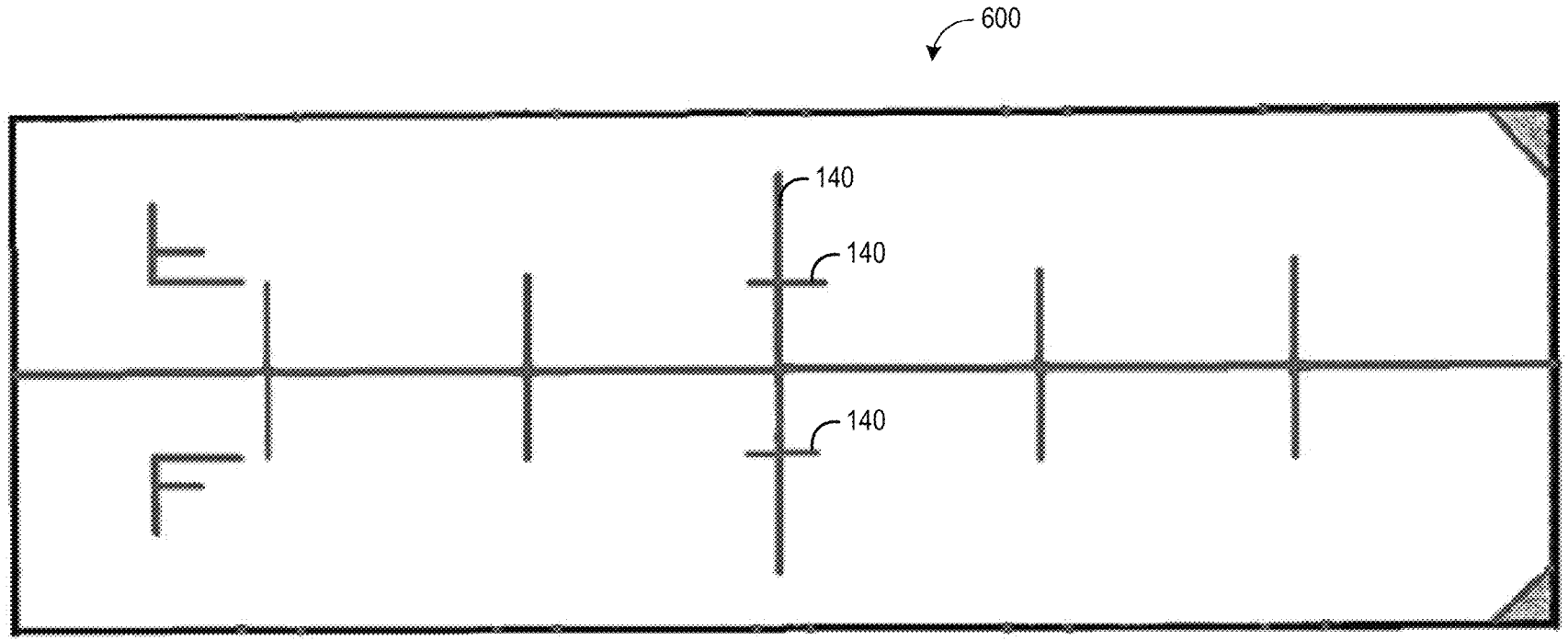

FIG. 6 illustrates a sixth embodiment of a towel or mat 600 that can be used to help a user align and/or place the user's limbs or any body part to perform one or more yoga positions. The towel or mat 600 includes all the marks of FIG. 5 and adds two short length-wise lines 140 perpendicular to the width-wise center line 115. In some implementations, the distance between the two short length-wise lines 140 is 10 inches. In some implementations, the distance between the two short length-wise lines 140 is any other distance. In some implementation, distance between the two short length-wise lines 140 is the length of the width-wise lines 130. Thus, the two short length-wise lines 140 can be used to measure a distance. Furthermore, the two short length-wise lines 140 can be used to help a user align and position body parts a certain distance apart for those postures that requires such positions. For example, some postures require the user to keep the user's feet 10 inches apart. Thus, the user could use the two short length-wise lines 140 to measure distance to help ensure that the user's feet are the requisite distance apart. For example, the two short length-wise lines 140 can be used to aide a user to achieve the Awkward Pose in Bikram Yoga.

Figure 7:
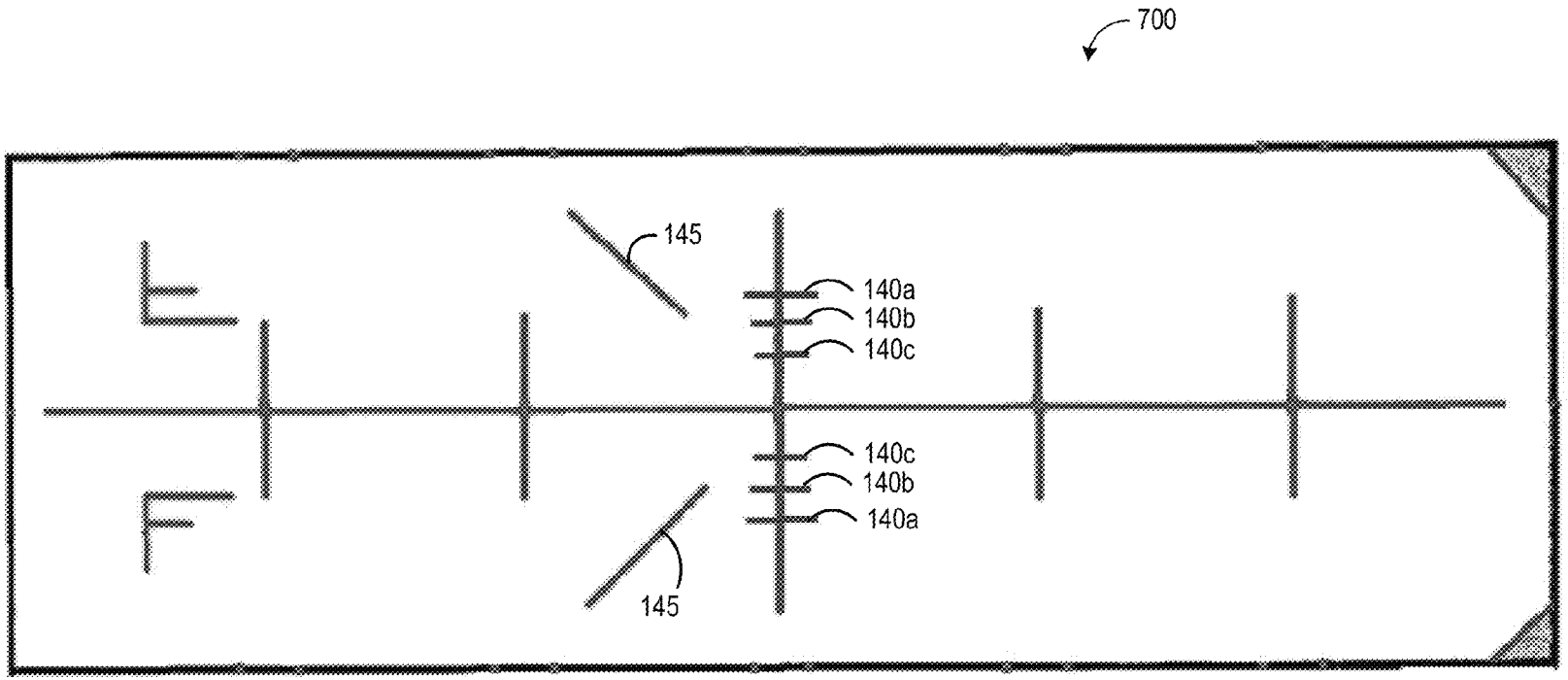

FIG. 7 illustrates a seventh embodiment of a towel or mat 700 that can be used to help a user align and place the user's limbs or any body part to achieve one or more yoga positions. The towel or mat 700 includes all the marks of FIG. 6 and adds additional pairs of short length-wise lines 140 perpendicular to the width-wise center line 115. Each pair of short length-wise lines 140 (one line on each side of the length-wise center line 110, i.e. 140*a,a;* 140*b,b;* 140*c,c*) measure a different distance. For example, the distance between lines 140*c,c,* can be six inches; the distance between lines 140*b,b* can be eight inches; and the distance between lines 140*a,a* can be ten inches. These additional pairs are lines 140 scan serve the same purpose as the pair of lines 140 in FIG. 6 and described above. The pairs of lines 140 can be used to accommodate different users with different body feet span as they perform the same postures.

The towel or mat 700 also adds diagonal lines 145. The diagonal lines 145 are perpendicular to each other. Thus, the diagonal lines 145 can be used to help a user align and position body parts at ninety degree angles for those postures that requires such positions. For example, the diagonal lines 145 can be used to aide a user to achieve the Sitting Head to Knee Pose and Stretching Pose in Bikram Yoga. More specifically, in the Sitting Head to Knee Pose and Stretching Pose, the foot of one leg is pressed tightly against the thigh muscles (Biceps) of the other leg and the two legs are perpendicular to each other. A person can use the length-wise center line 110 to sit and the stretch the legs in the direction of the diagonal lines 145.

Figure 8:
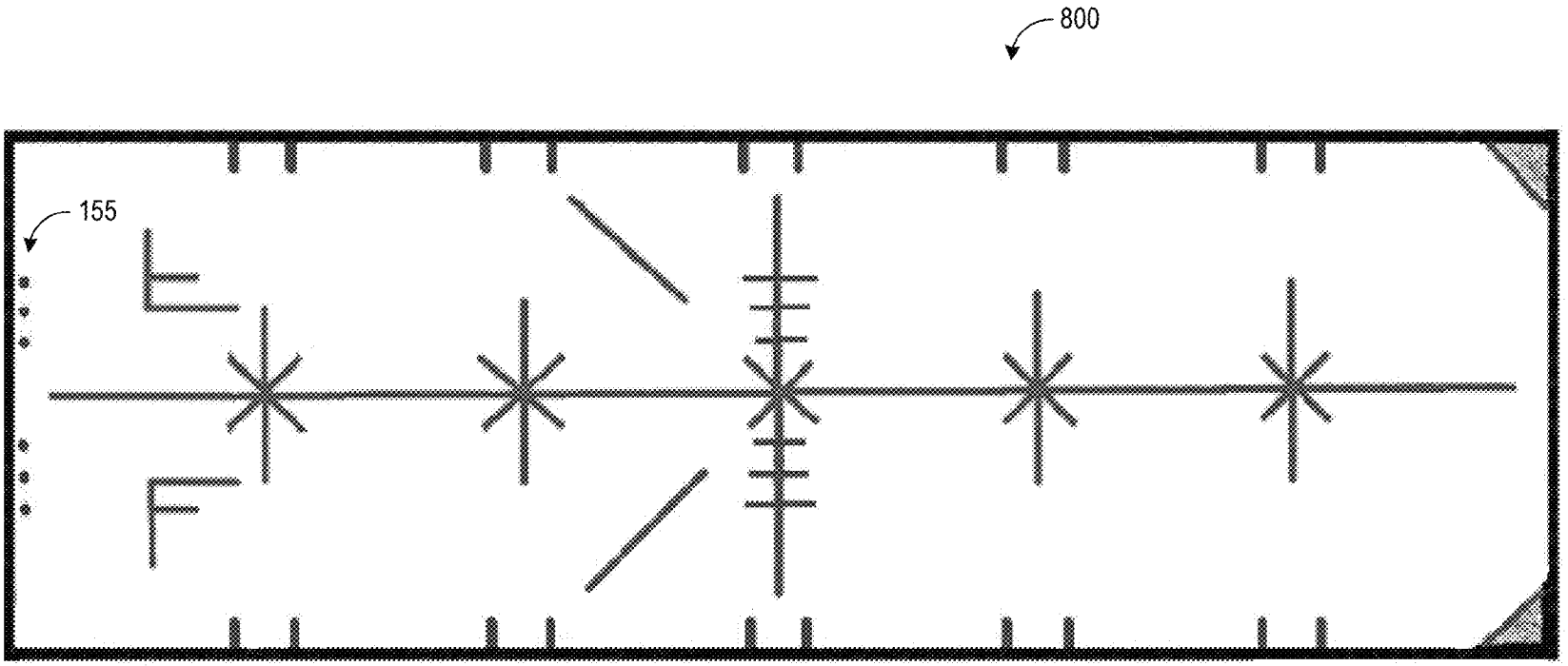

FIG. 8 illustrates an eight embodiment of a towel or mat 800 that can be used to help a user align and/or place the user's limbs or any body part to achieve one or more yoga positions. The towel or mat 800 includes the marks from FIGS. 3 and 7 and adds dots 150 at an end (e.g., the top end) of the towel or mat 800. Each pair of dots 150 (one dot on each side of the length-wise center line 110, i.e. 150*a,a;* 150*b,b;* 150*c,c*) measure a different distance. For example, the distance between dots 150*c,c,* can be six inches; the distance between dots 150*b,b* can be eight inches; and the distance between dots 150*a,a* can be ten inches. The dots 150 can be used to aide a user to achieve the Camel Pose in Bikram Yoga, for example. A pair of dots can be used to align and/or place the user's knees.

Figure 9:
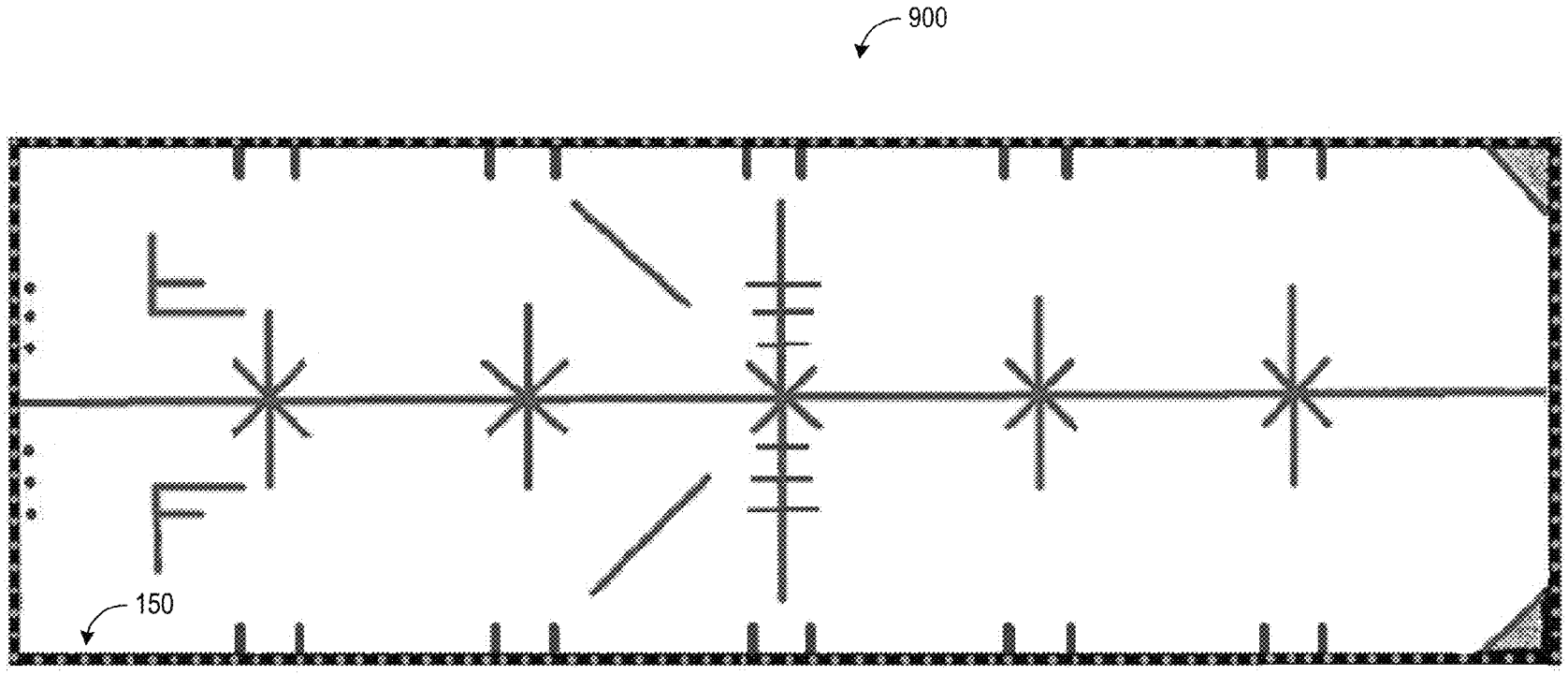

FIG. 9 illustrates a ninth embodiment of a towel or mat 900 that can be used to help a user align and/or place the user's limbs or any body part to perform one or more yoga positions. The towel or mat 900 includes the marks from FIG. 8 and adds dots 155 around the perimeter of the towel or mat 800. In some implementations, the dots 155 are spaced one inch from each other. In some implementations, the dots 155 are spaced any other distance from each other. These dots 155 allow a user to measure distance on a more minute level. Thus the user may use the marks and the dots 155 to more accurately measure distance to help a user align and position body parts a certain distance apart for those postures that requires such positions. In some implementations, the dots 155 re joined together to form a grid in the background to the main design further allowing the user to more accurately measure distance.

Figure 10:
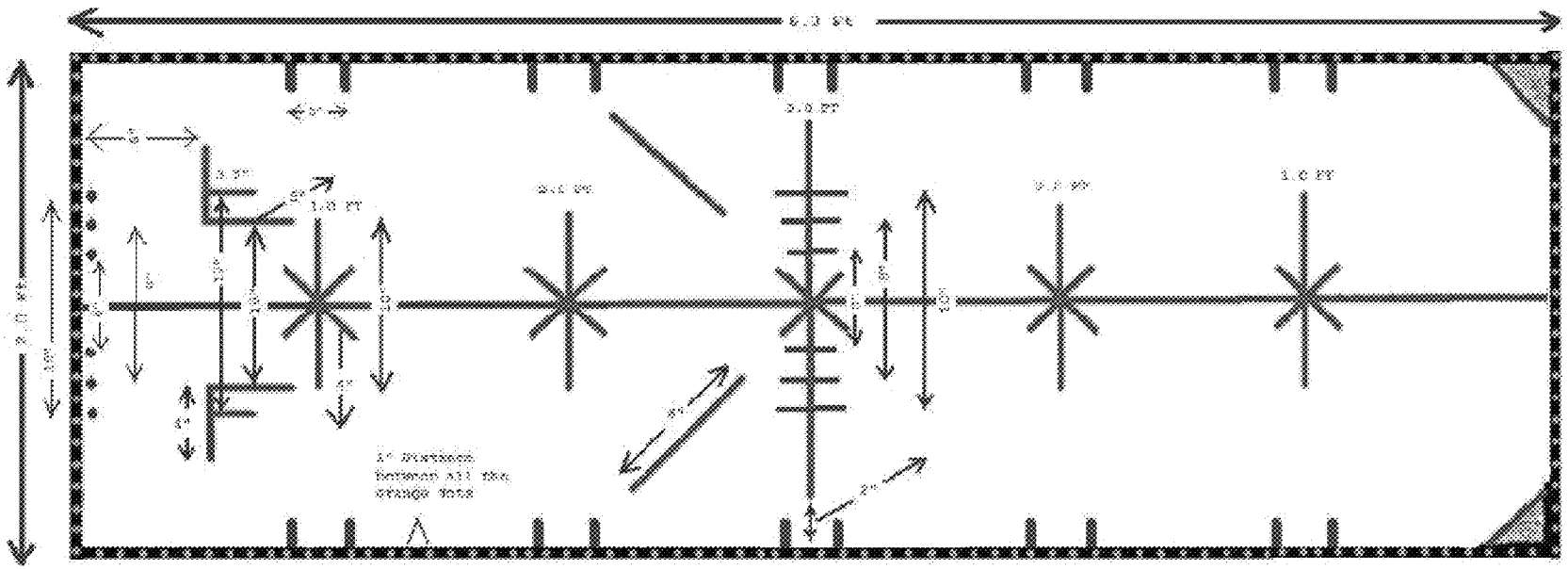
FIG. 10 illustrates example measurements for the embodiments of FIGS. 1-9.
Figure 10A:
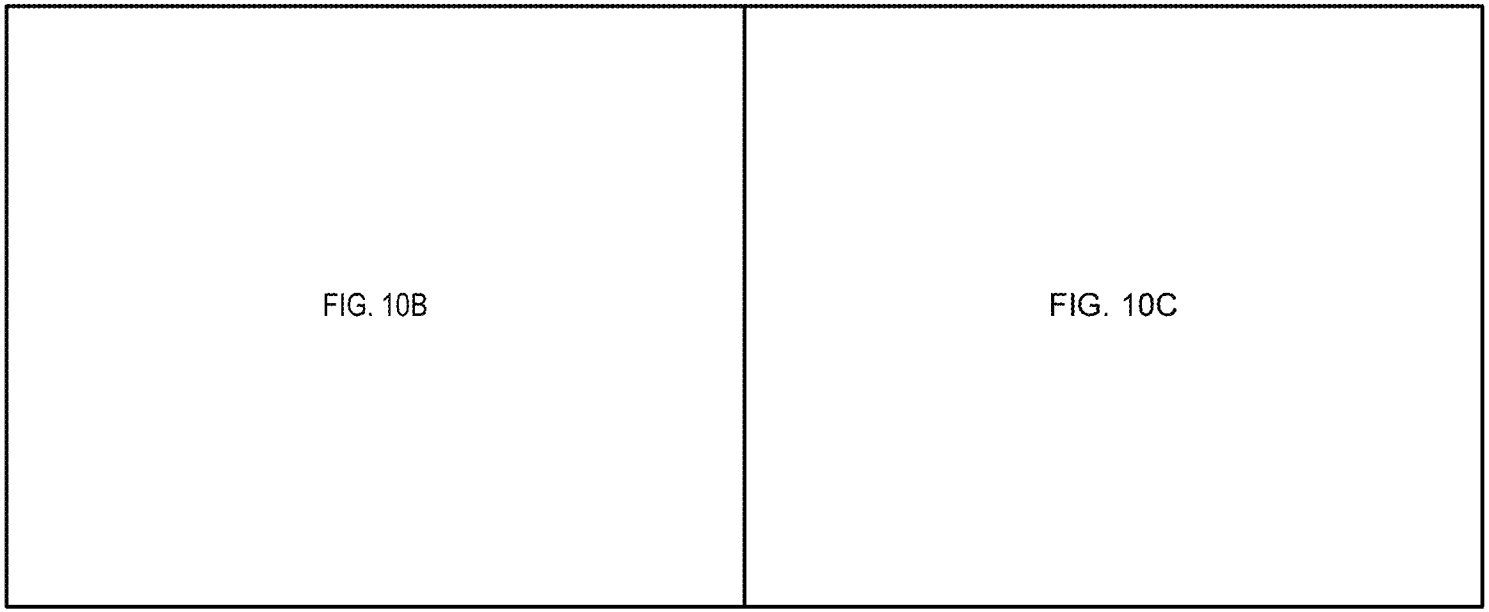
Figure 10B:
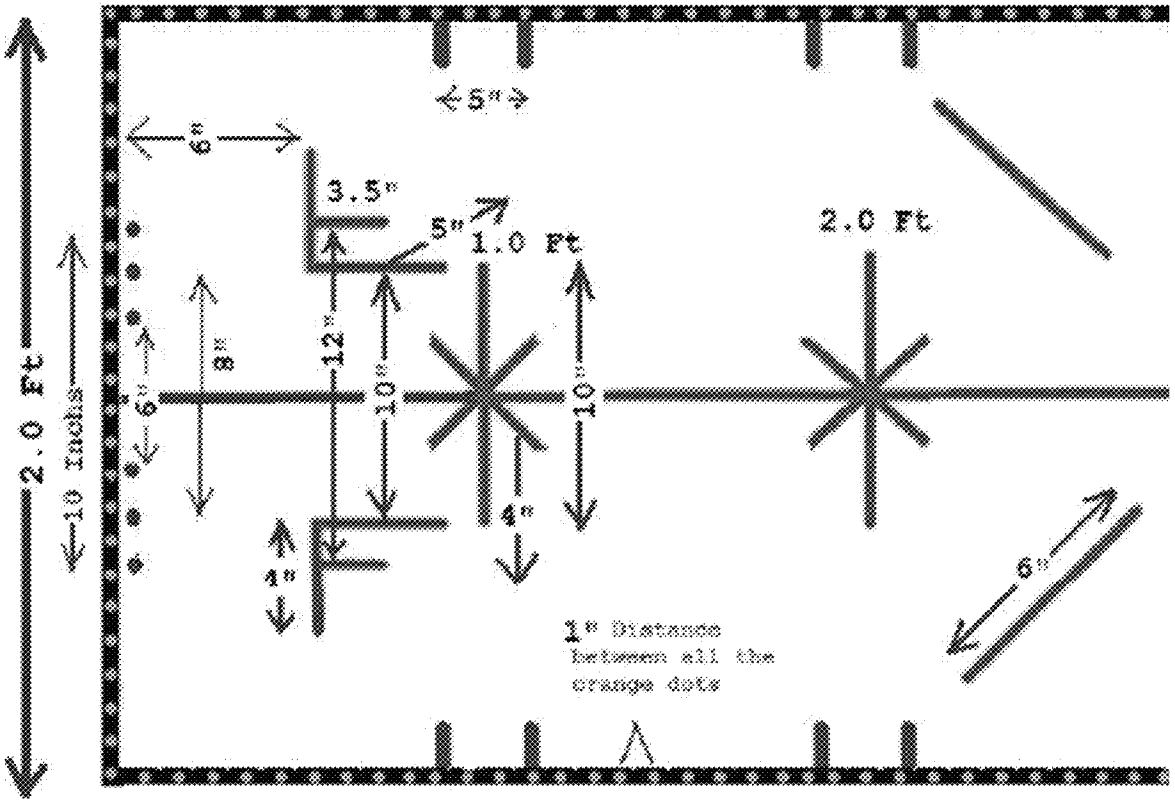
Figure 10C:
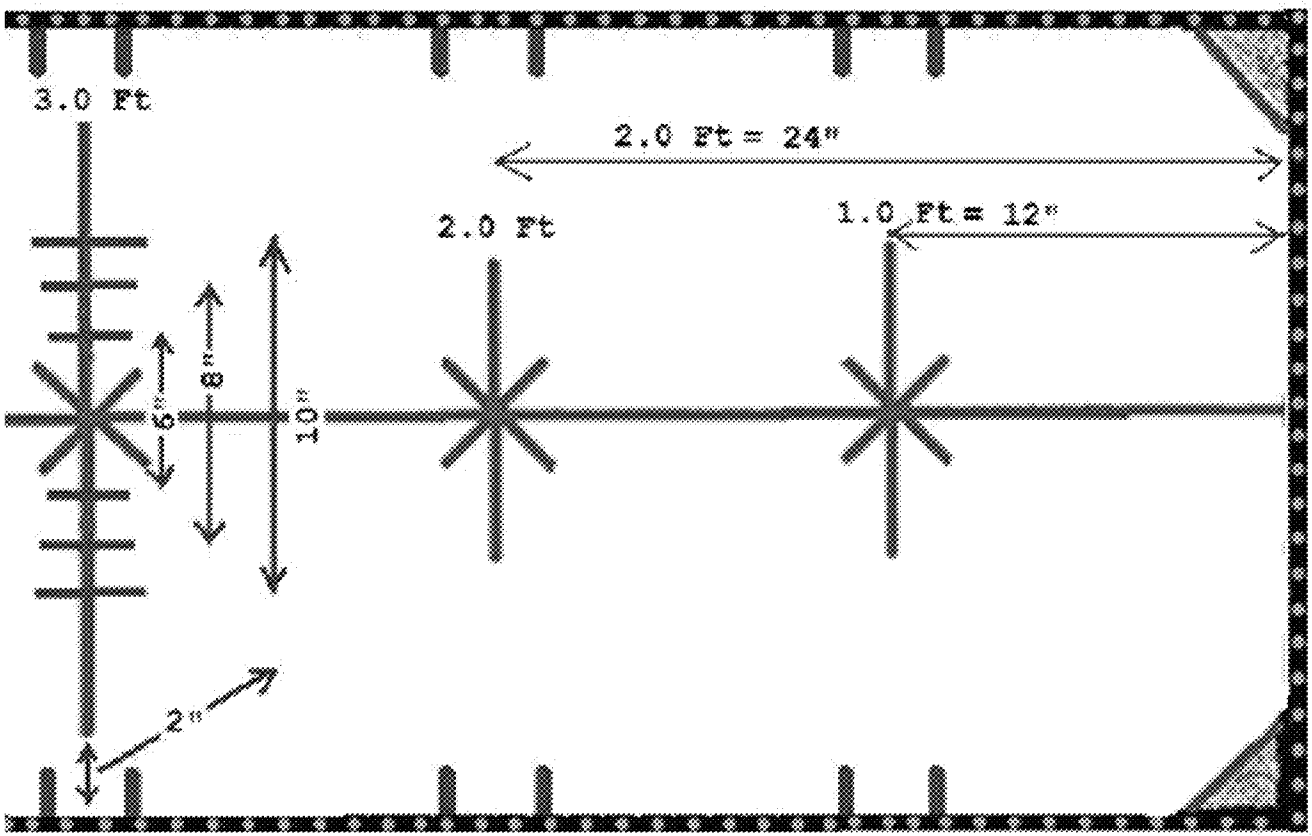

FIG. 10 illustrates example measurements for the embodiments of FIGS. 1-9.

Various implementations of a towel or mat can include various combinations or alternative implementations of the markings discussed above. In some implementations, a towel or mat according to the present disclosure can include a dot in the center of the towel or mat to be used as a focus point or drishti.

Implementations of the towel can include any material. In some implementations, a towel according to the present disclosure includes organic material. In some implementation, a towel according to the present disclosure can be a thin microfiber towel that can have silicone nubs on one side. In some implementation, a towel according to the present disclosure includes piping around the edges. In some implementations, the towel is sized to cover the entire mat so that marks on the towel can be utilized while practicing yoga.

In some implementations, the marks according to the present disclosure can be printed or embossed or stitched, inward or outward, on a towel or mat.

Reference throughout this specification to "an embodiment" or "implementation" or words of similar import means that a particular described feature, structure, or characteristic is included in at least one embodiment of the present invention. Thus, the phrase "in an embodiment" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A rectangular apparatus comprising:

a plurality of markings to help a user align and place a body part, wherein the plurality of markings includes:

a length-wise center line that extends length-wise along the center of the rectangular apparatus; and a plurality of double line sets extending from a lengthwise edge of the rectangular apparatus, each of said double line sets is comprised of two parallel lines wherein each line within said double line set extends from a single edge of the rectangular apparatus at an angle perpendicular to said length-wise center line, each of said double line sets extends from said single edge a distance less than half the width of the rectangular apparatus.

2. A method utilizing the rectangular apparatus of claim 1 wherein a user aligns at least one body part based on the length-wise center line.

3. The rectangular apparatus of claim 1 further comprising a width-wise center line that extends width-wise along the center of the rectangular apparatus.

4. A method utilizing the rectangular apparatus of claim 1 wherein a user aligns a plurality of body parts based on the length-wise center line and the width-wise center line.

5. The rectangular apparatus of claim 1 further comprising a plurality of crosses along the length-wise center line wherein the distance between the crosses is a predetermined distance and the lines of the crosses and the length-wise center line measure forty-five degrees.

6. A method utilizing the rectangular apparatus of claim 4 wherein a user aligns a plurality of body parts based on the length-wise center line and a lie of a cross.

7. A method utilizing the rectangular apparatus of claim 1 wherein a user aligns a plurality of body parts based on one set of double lines.

8. The rectangular apparatus of claim 3 further comprising a plurality of width-wise lines along the length-wise center line wherein the width-wise lines and the width-wise center line are spaced apart by a predetermined distance.

9. A method utilizing the rectangular apparatus of claim 8 wherein a user aligns a plurality of body parts based on a plurality of width-wise lines.

10. The rectangular apparatus of claim 1 further comprising a plurality of F-designs.

11. A method utilizing the rectangular apparatus of claim 10 wherein a user aligns a user's hand using the plurality of F-designs to perform the Cobra Pose.

12. The rectangular apparatus of claim 3 further comprising two short length-wise lines perpendicular to the width-wise center line wherein the distance between the two short length-wise lines is a predetermined distance.

13. The rectangular apparatus of claim 1 further comprising additional pairs of short length-wise lines perpendicular to the width-wise center line wherein each pair of short length-wise lines measure a different distance.

14. A method utilizing the rectangular apparatus of claim 13 wherein a user aligns a plurality of body parts based on a pair of short length-wise lines and the size of the user.

15. The rectangular apparatus of claim 1 further comprising a pair of diagonal lines perpendicular to each other.

16. A method utilizing the rectangular apparatus of claim 15 wherein a user aligns a plurality of body parts based on the pair of diagonal lines.

17. A method utilizing the rectangular apparatus of claim 15 wherein a users aligns a users legs based on the pair of diagonal lines to perform the Sitting Head to Knee Pose and Stretching Pose.

18. The rectangular apparatus of claim 1 further comprises markings around the perimeter of the rectangular apparatus wherein the markings are spaced apart by a predetermined distance.

19. A rectangular apparatus comprising:

a plurality of markings to help a user align and place a body part, wherein the plurality of markings includes:

a length-wise center line that extends length-wise along the center of the rectangular apparatus;

a width-wise center line that extends width-wise along the center of the rectangular apparatus;

a plurality of crosses along the length-wise center line wherein the distance between the crosses is a predetermined distance and the lines of the crosses and the length-wise center line measure forty-five degrees;

a plurality of double line sets extending from a lengthwise edge of the rectangular apparatus, each of said double line sets is comprised of two parallel lines wherein each line within said double line set extends from a single edge of the rectangular apparatus at an angle perpendicular to said length-wise center line, each of said double line sets extends from said single edge a distance less than half the width of the rectangular apparatus;

a plurality of width-wise lines along the length-wise center line wherein the width-wise lines and the width-wise center line are spaced apart by a predetermined distance;

a plurality of F-designs; and a pair of diagonal lines perpendicular to each other.

* * * * *